US007633446B2

(12) United States Patent
Fang et al.

(10) Patent No.: US 7,633,446 B2
(45) Date of Patent: Dec. 15, 2009

(54) ANTENNA APPARATUS AND MOBILE COMMUNICATION DEVICE USING THE SAME

(75) Inventors: Shyh-Tirng Fang, Tai-Nan (TW); Meng-Hann Shieh, Hsinchu (TW)

(73) Assignee: Mediatek Inc., Hsin-Chu (TW)

( * ) Notice: Subject to any disclaimer, the term of this patent is extended or adjusted under 35 U.S.C. 154(b) by 525 days.

(21) Appl. No.: 11/424,041

(22) Filed: Jun. 14, 2006

(65) Prior Publication Data

US 2007/0194995 A1 Aug. 23, 2007

Related U.S. Application Data

(60) Provisional application No. 60/780,007, filed on Mar. 7, 2006, provisional application No. 60/775,575, filed on Feb. 22, 2006.

(51) Int. Cl.
*H01Q 1/24* (2006.01)

(52) U.S. Cl. ..... 343/702; 343/700 MS

(58) Field of Classification Search ..... 343/700 MS, 343/702, 846

See application file for complete search history.

(56) References Cited

U.S. PATENT DOCUMENTS 5,999,146 A * 12/1999 Kanba et al. ..... 343/895
6,297,776 B1 * 10/2001 Pankinaho ..... 343/700 MS
6,339,402 B1 * 1/2002 McKivergan ..... 343/702
6,650,294 B2 * 11/2003 Ying et al. ..... 343/700 MS
6,970,140 B2 11/2005 Hobino et al.
2003/0122716 A1 * 7/2003 Ellis et al. ..... 343/702
2003/0151555 A1 * 8/2003 Holshouser ..... 343/700 MS
2006/0061508 A1 * 3/2006 Yanagi et al. ..... 343/700 MS
2006/0114159 A1 * 6/2006 Yoshikawa et al. ..... 343/702

FOREIGN PATENT DOCUMENTS

TW 200633303 A 9/2006

OTHER PUBLICATIONS

English Language Abstract of TW 200633303A, published Sep. 16, 2006.

TW Office Action mailed in counterpart application being prosecuted in Taiwan Patent Office, on Jun. 24, 2009.

* cited by examiner

*Primary Examiner*—HoangAnh T Le
(74) *Attorney, Agent, or Firm*—Thomas, Kayden, Horstemeyer & Risley

(57) ABSTRACT

An antenna apparatus having an antenna unit with length shorter than ¼ the operating wavelength. The antenna unit formed on a first plane can be arranged to set a first distance and a first angle with respect to a ground plane of the antenna apparatus, to tune and improve impedance matching between the antenna unit and a communication module coupled to the antenna unit. A mobile communication device using the antenna apparatus is also disclosed.

28 Claims, 16 Drawing Sheets

ANTENNA APPARATUS AND MOBILE COMMUNICATION DEVICE USING THE SAME

CROSS REFERENCE TO RELATED APPILCATIONS

This application claims the full benefit and priority of provisional U.S. Patent Application Ser. No. 60/775,575, filed Feb. 22, 2006, entitled "An Electrically Small Antenna Apparatus", inventor Fang, and provisional U.S. Patent Application Ser. No. 60/780,007, filed Mar. 7, 2006, entitled "An Electrically Small Antenna Apparatus", inventor Fang, and incorporates the entire contents of said applications herein.

BACKGROUND OF THE INVENTION

1. Field of the Invention

The invention relates to an antenna apparatus using an antenna unit with length shorter than ¼ the transmission or reception wavelength, and a mobile communication device using the same.

2. Description of the Related Art

Design goals for personal mobile communication devices or wireless terminal equipment focus on light weight, thinness, compact profile and good communication quality. Mobile phones, for example, feature small streamlined models with multiple functions and applications, and low cost.

Wireless communication equipment requires more than one antenna such that multiple communication systems can be integrated and applied. Hence, it becomes a design issue and a critical problem to arrange the antennas in the wireless communication equipment and determine dimensions of antennas. In mobile phones, GSM systems of 850/900/1800/1900 MHz, WCDMA or CDMA2000 system, Bluetooth system and wireless LAN of 2400 or 5200/5800 MHz may be integrated into a single mobile phone, requiring more than 3 antennas. Fortunately, GSM, WCDMA, CDMA2000, Bluetooth and wireless LAN systems all operate in the frequency band above 1 GHz, such that necessary antennas can be configured in the mobile phone with great effort by designing the antennas based on ¼ wavelength antenna.

However, it is difficult to integrate additional wireless communication systems, such as HF, VHF or UHF system operating in the frequency band below 1 GHz, into a single wireless communication equipment like a mobile phone, because the dimension of the antenna for HF, VHF or UHF system is too large to be configured into the mobile phone when designing ¼ wavelength antenna. Manufacturers either configure HF, VHF or UHF antenna outside the housing of the mobile, or enlarge dimensions of the mobile phone to enclose large HF, VHF or UHF antenna, therefore degrading elegant profile of the mobile phone and increasing production costs. FM radio systems operate in the frequency range of about 88~108 MHz within VHF band. External earphones are required to serve as antennas for reception thereof, when providing FM radio systems in mobile phones. However, it is inconvenient for users to prepare earphones to listen FM radio.

FIG. 1 shows equivalent circuit diagram of an antenna apparatus with length shorter than ¼ the operating wavelength, disclosed by U.S. Pat. No. 6,970,140. The antenna apparatus 100 comprises an antenna unit 11, a resistor 12 and a matching circuit 13, connected in series in this sequence. Generally, real part of input impedance (i.e., input resistance) of the antenna unit 11 is very small and less than real part of input impedance of a circuit unit 14. Hence, impedance matching (using only the matching circuit 13) can not increase the input resistance of the antenna unit 11 to equal that of the circuit unit 14. To solve this problem, U.S. Pat. No. 6,970,140 further discloses coupling the resistor 12 between the antenna unit 11 and the matching circuit 13. However, the resistor 12 consumes considerable energy transmitted between the antenna unit 11 and the circuit 14, degrading communication performance.

Accordingly, it is desirable to have an antenna apparatus having an antenna unit with length shorter than ¼ the operating wavelength of the antenna apparatus. In addition, the antenna unit on a first plane can be arranged to set a first distance or a first angle with respect to a ground plane of the antenna apparatus, thereby improving impedance matching between the antenna unit and a communication module coupled thereto, and increasing radiation efficiency thereof. Consequently, the antenna apparatus can be applied to mobile communication devices without affecting appearance or cost.

SUMMARY

According to the invention, an antenna apparatus applicable for a wireless device operated in a frequency band comprises an antenna unit comprising a first conductor, having a first end for feeding signals and a second end, and a ground plane providing a ground reference to the signals. The first conductor and the ground plane have a first distance or an angle, and the first distance or the angle is adjustable to improve impedance matching of the antenna apparatus.

According to the invention, an antenna apparatus applicable for a wireless device operated in a frequency band is provided, wherein the wireless device has a circuit module and a ground plane. The antenna apparatus comprises an antenna unit comprising a first conductor having a first end for feeding signals and a second end; and a reactive device, coupled to the first end and the circuit module, for feeding signals from the circuit module to the first end of the first conductor, wherein the reactive device having inductive components or capacitive components. The first conductor and the ground plane have a first distance or an angle, the antenna unit has an input impedance having a real part and an imaginary part, the real part of the input impedance is adjustable by changing the first distance or the angle and the imaginary part of the input impedance is adjustable by tuning the reactive device.

It is noted that length of the first conductor of the antenna unit is shorter than ¼ the operating wavelength of the antenna apparatus, and the area of the first conductor is less than 1/64 the square of the operating wavelength of the antenna apparatus.

DESCRIPTION OF THE DRAWINGS

The invention will become more fully understood from the detailed description, given hereinbelow, and the accompanying drawings. The drawings and description are provided for purposes of illustration only and, thus, are not intended to be limiting of the present invention.

DETAILED DESCRIPTION OF THE INVENTION

The antenna for low frequency system, such as HF, VHF or UHF system, is too large to be configured into mobile phones when using conventional ¼ wavelength antenna, and therefore the invention provides an small antenna apparatus to overcome this problem.

The present invention provides an antenna apparatus with length shorter than ¼ operating wavelength, which may be easily applied to mobile phones or any wireless devices. Preferably, the antenna apparatus of the present invention is designated for receiving and transmitting low frequency signals, such as signals with frequency under 1 GHz, like FM/AM signals. For brevity, mobile phones are used here as examples of mobile communication devices to describe the invention. Applications of the invention however should not be limited to mobile phones. Any wireless devices should be covered by the claimed invention.

Figure 2B:
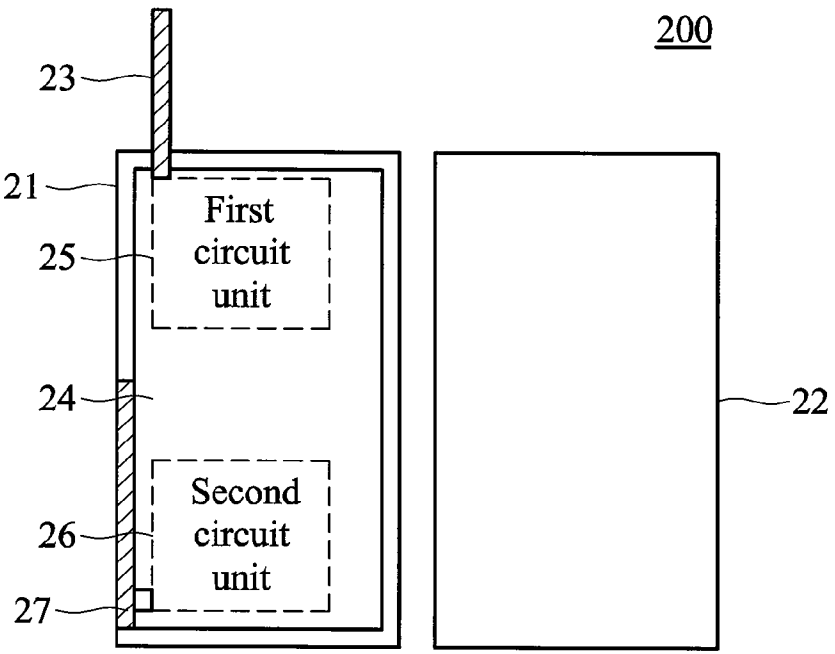
FIGS. 2A and 2B schematically show mobile phones with antenna apparatuses of the present invention.
Figure 2A:
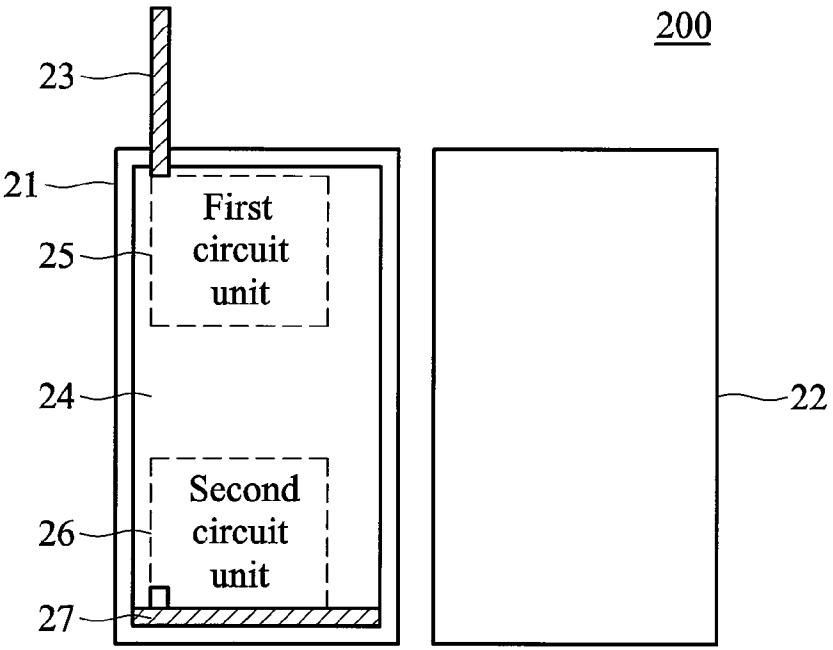

FIGS. 2A and 2B schematically show mobile phones with the antenna apparatuses of the present invention . In FIG. 2A or 2B, the mobile phone 200 comprises a front housing 21, a rear housing 22, an main antenna 23 which may be an exposed or embedded antenna and an antenna apparatus 27 arranged inside the mobile phone 200. In this examples of FIG. 2A and FIG. 2B, the main antenna 23 is an exposed antenna configured outside the mobile phone 100. The main antenna 23 is for receiving and transmitting high frequency signals via GSM, GPRS, EDGE, WCDMA, CDMA2000, Bluetooth and wireless LAN communication network, and the antenna apparatus 27 on the other hand is designated to receive and transmit low frequency signals, such as signals with frequency under 1 GHz, like FM/AM signals. The mobile phone 200 further comprises a first circuit unit 25, having at least a radio frequency (RF) module and a base band (BB) module, coupled to the main antenna 23, a second circuit unit 26, having a FM/AM radio circuit module, coupled to the antenna apparatus 27, and a main circuit board 24 having the first and second circuit units provided thereon. Here, the main circuit board 24 is a PCB board.

The first circuit unit 25 enables communication between the mobile phone 200 and the base station, providing at least one of GSM, GPRS, EDGE, WCDMA, CDMA2000, Bluetooth and wireless LAN systems, etc. for users, and therefore the main antenna 23 operates in the frequency band around or above 1 GHz. In addition, the second circuit unit 26 provides an additional wireless communication system, such as HF, VHF or UHF system operating in the frequency band below 1 GHz, to be integrated into the mobile phone 200. The HF, VHF or UHF system may be FM (Frequency Modulation) system, AM (Amplitude modulation) system, transceivers or DTV (Digital Television) system, etc. Here, the second circuit unit 26 is a FM module, as an example, and therefore the antenna apparatus 27 operates in the frequency band of 88 to 108 MHz.

As shown in FIG. 2A and FIG. 2B, the present invention provides an antenna apparatus 27 with length shorter than ¼ operating wavelength which can be easily placed in either side of the mobile phone 200.

Figure 3:
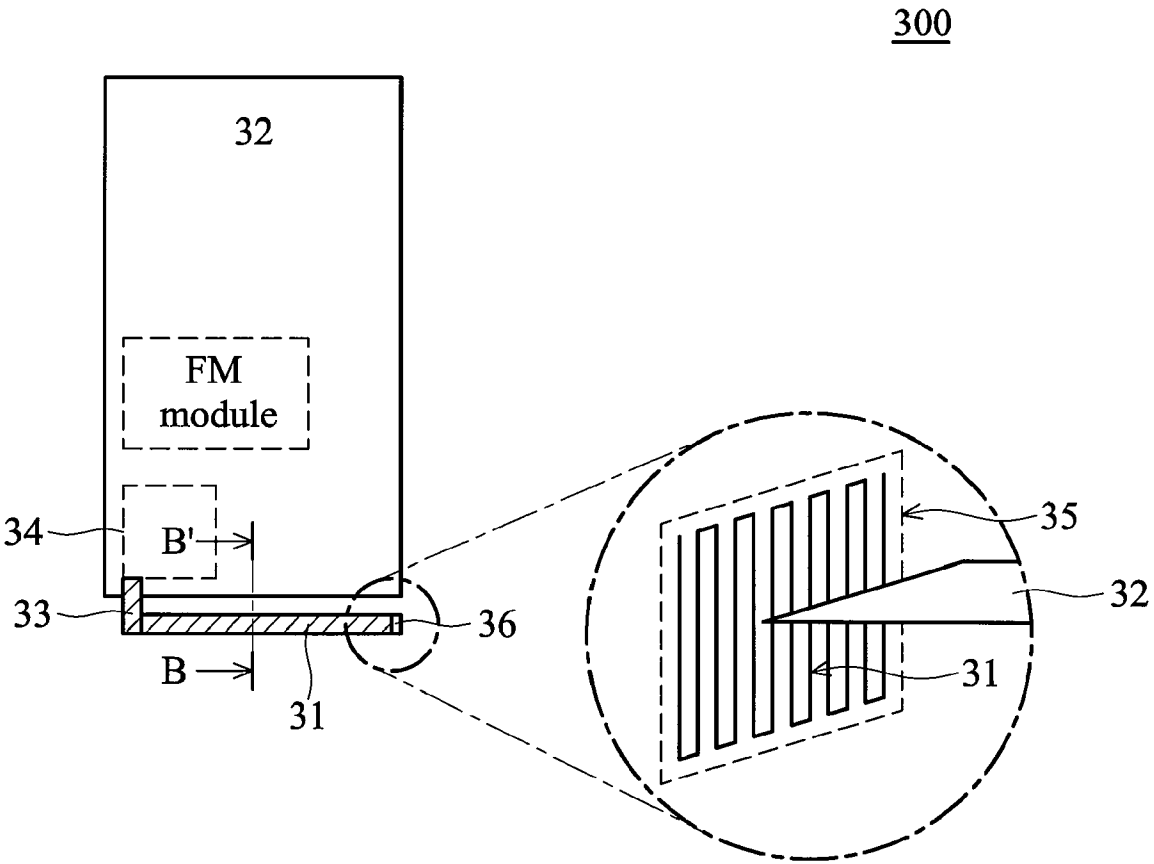
FIG. 3 schematically shows an antenna apparatus according to the invention.

FIG. 3 schematically shows an antenna apparatus 300 according to the invention. The antenna apparatus 300 applicable for a wireless device, operated in a frequency band, for example, 88 to 108 MHz, comprises an antenna unit 31 with a first conductor 31 extending on a first plane 35, having a first end 33 for feeding signals from/to a FM module, such as the second circuit unit 26 shown in FIG. 2A or 2B, and a second end 36; and a ground plane 32 providing a ground reference to the signals. It is noted that the ground plane 32 can be configured in the main circuit board 24 when applied to the mobile phone 200 of FIG. 2A or 2B, in this embodiment. The length of the antenna unit 31 is shorter than ¼ the operating wavelength of FM radio band (or ¼ operating wavelength of the antenna unit). The antenna apparatus 300 can further comprise a reactance device 34 coupled between the antenna unit 31 and the FM module (second circuit unit) for impedance matching of the antenna apparatus 300. The reactance device 34 may include only inductive and/or capacitive components. In some embodiments, it may further include resistors. The design of the reactance device 34 is not limited in the present invention.

Figure 4A:
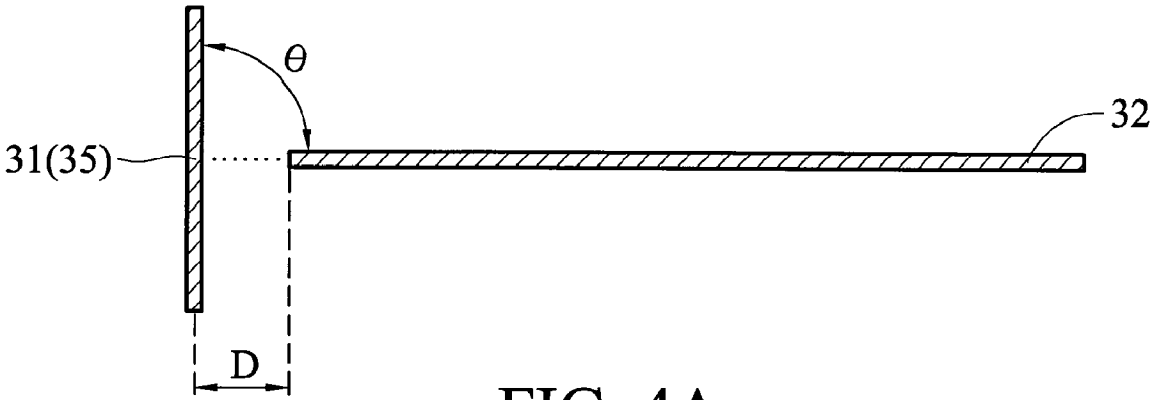
FIGS. 4A and 4B schematically show arrangements of the antenna unit 31 and the ground plane 32, in cross section along line B-B' in FIG. 3.
Figure 4B:
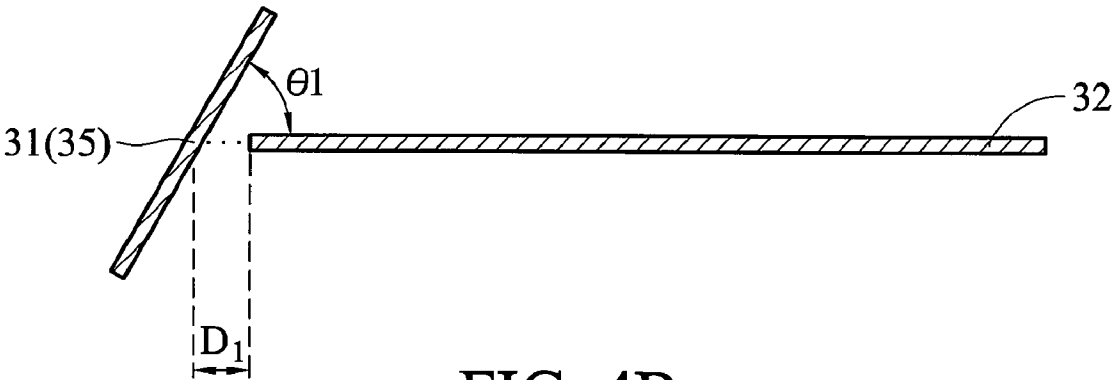

FIGS. 4A and 4B schematically show arrangements of the antenna unit 31 and the ground plane 32, between cross section B-B' in FIG. 3. The antenna unit 31 is arranged to set a first distance D and a first angle θ between the first plane 35 (on which the antenna unit 31 is configured, as depicted in FIG. 3) and the ground plane 32 configured on the main circuit board 24. The antenna unit 31 has real part and imaginary part of input impedance. The real part of input impedance of the antenna unit 31 can be tuned by adjusting the first distance D or the first angle θ. The first angle is set between 0 to 90 degrees. For example, the first distance and first angle in FIG. 4B can be set as D1 and θ1 to adjust the real part of input impedance of the antenna unit 31.

Figure 1:
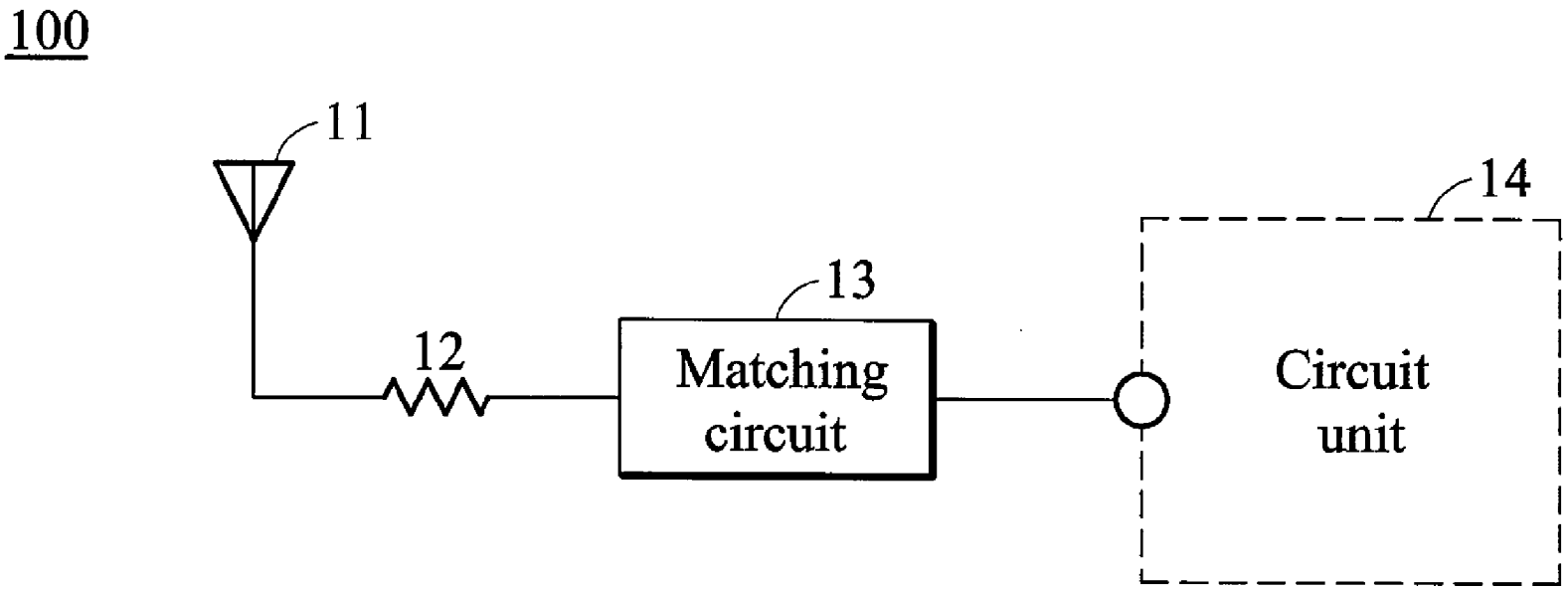
FIG. 1 (RELATED ART)
FIG. 1 is an equivalent circuit diagram of an antenna apparatus disclosed in U.S. Pat. No. 6,970,140.
Figure 5:
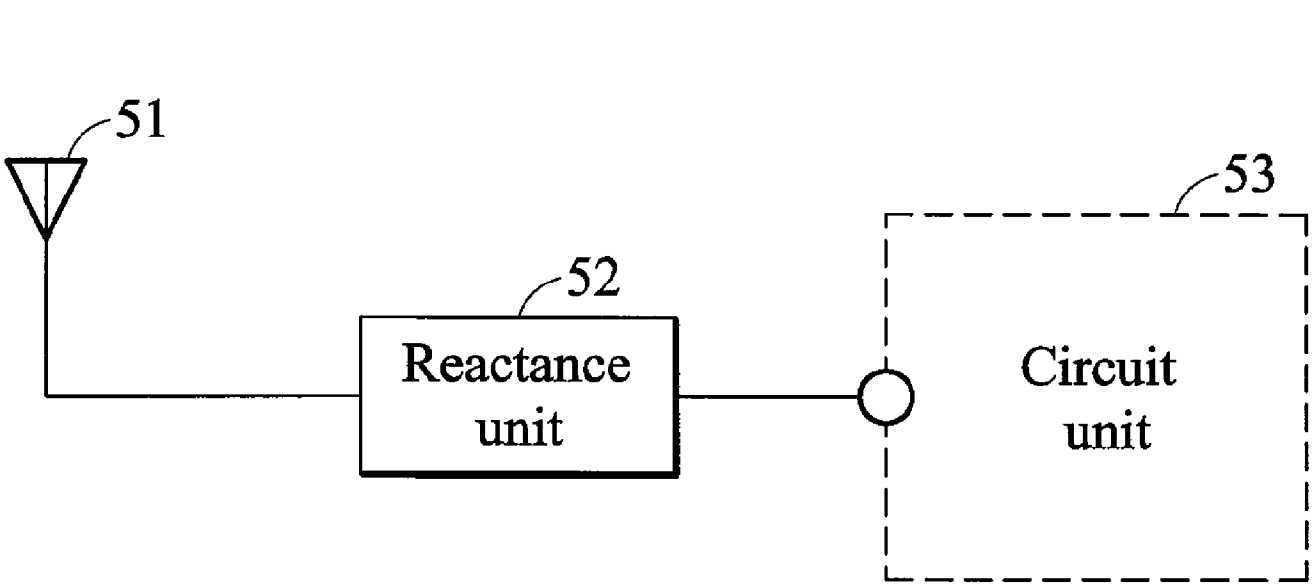
FIG. 5 is an equivalent circuit diagram of the antenna apparatus according to the invention.

FIG. 5 shows equivalent circuit diagram of an antenna apparatus 500 according to the invention. The antenna unit 51 of the antenna apparatus 500 shorter than ¼ the operating wavelength is coupled to a circuit unit 53 (FM module, for example) through a reactance device 52, including at least an inductive device or capacitive device. According to the invention, the real part of input impedance of the antenna unit 51 can be tuned by setting the first distance D and the first angle θ, thereby achieving impedance matching to the real part of input impedance of the circuit unit. Consequently, additional resistor (as shown in FIG. 1) is not required between the antenna unit 52 and the circuit unit 53.

Figure 6A:
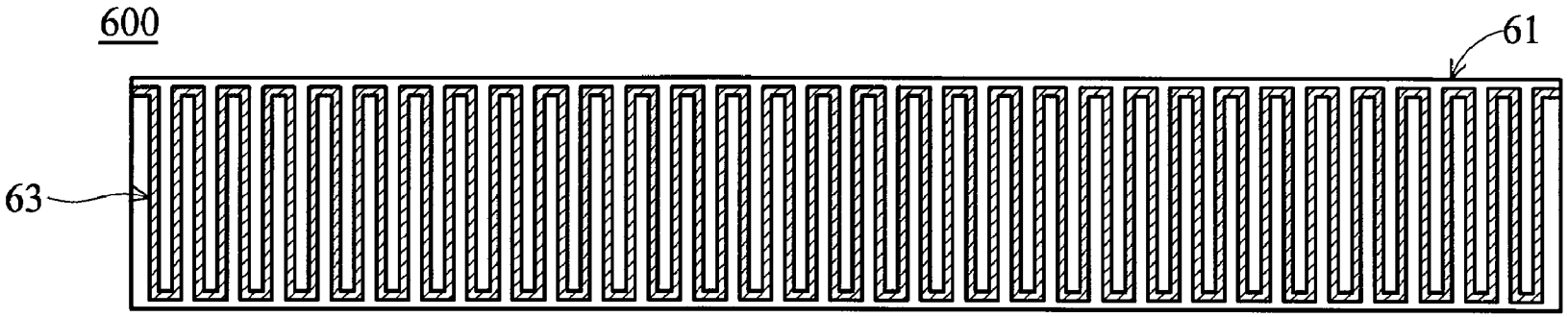
FIGS. 6A, 6B and 6C show three exemplary embodiments of the antenna unit 600 with inductive structure.
Figure 6B:
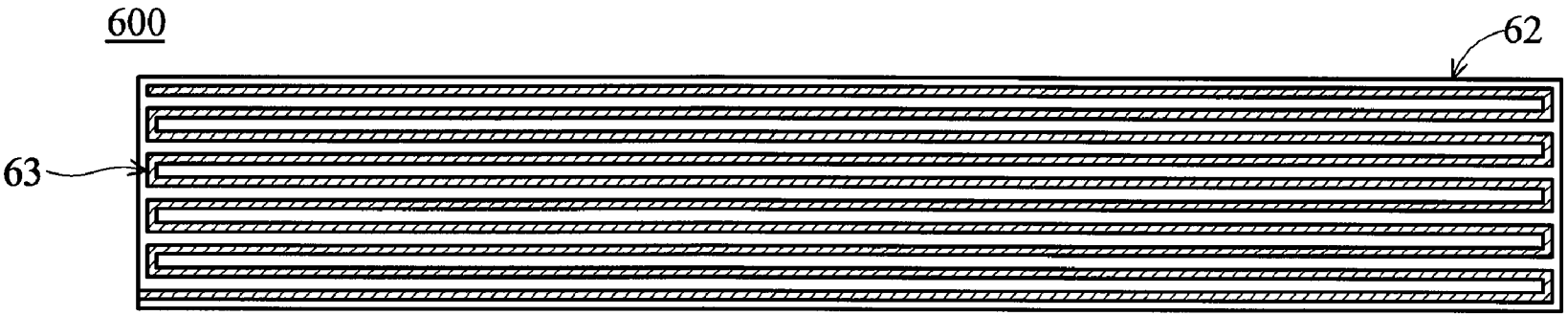
Figure 6C:
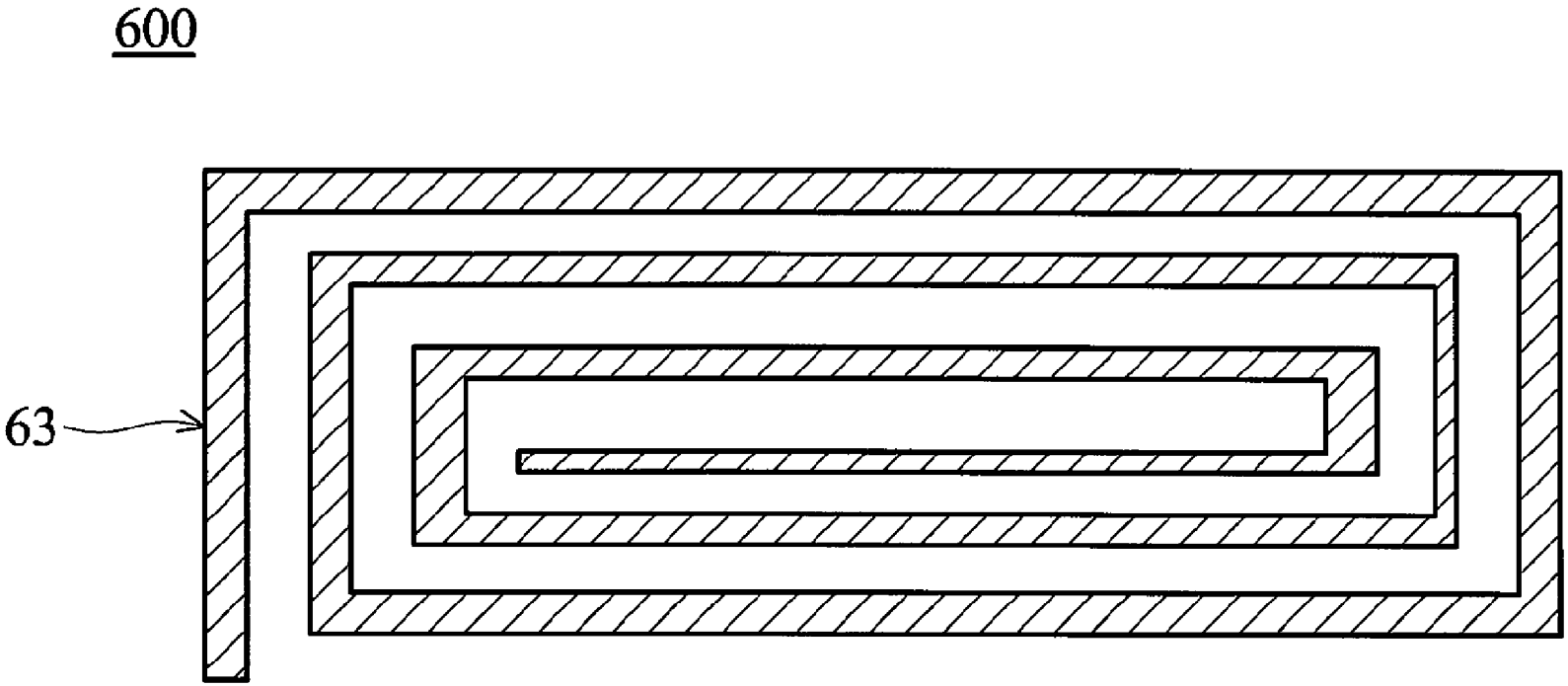

The antenna unit of the antenna apparatus may have inductive structure to improve imaginary part of input impedance of the antenna unit. Any structure of a conductor forming the antenna unit, which can increase inductance of the antenna unit, is inductive. FIGS. 6A, 6B and 6C show three exemplary embodiments of the antenna unit 600 with inductive structure. FIG. 6A or 6B shows the antenna unit 600, comprising a conductor 63, having meander line pattern, and FIG. 6C shows the conductor of the antenna unit has a spiral pattern. All antenna units shown in FIGS. 6A to 6C are reactance devices. Input reactance (imaginary part of input impedance) of an antenna unit (one end open as depicted in FIGS. 6A to 6C) with length shorter than ¼ the operating wavelength is negative and capacitive. Therefore, impedance matching can be easily achieved, using antenna unit with inductive structure in conjunction with an inductive component (inductor). It is noted that the area of the conductor 63 (hereinafter referred to as antenna area), depicted as the regions 61 and 62, is less than 1/64 square of operating wavelength of the antenna unit 600.

The extending conductor of the antenna unit can be formed by a metal line, metal sheet or a metal trace printed on a supporting member. The support member can be a circuit board, with one or multiple layers, with the metal trace printed on at least one layer of the circuit board.

Figure 7:
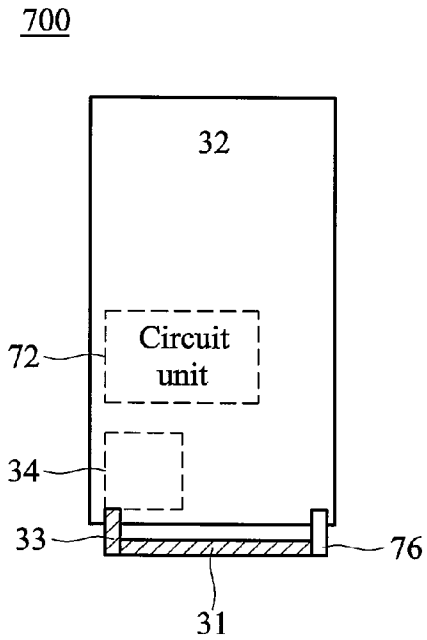
FIG. 7 schematically shows another antenna apparatus 700 according to the invention.

FIG. 7 schematically shows another antenna apparatus 700 according to the invention. A second end 76 of the antenna unit 31 is coupled to the ground plane 32. Input reactance (imaginary part of input impedance) of the antenna unit 71 with length shorter than ¼ the operating wavelength is positive and inductive. Therefore, capacitive devices (capacitors) can be used to match the impedance between the antenna unit and a circuit unit 72.

Referring to FIG. 4A, assuming that the antenna area is about 40×15 $mm^2$, the first angle θ is set to 90 degrees, then the preferred first distance D to be set is shorter than or equal to 15 mm for impedance matching, when operating in the band of about 88 to 108 MHz. The shorter the first distance D, the less the real part of input impedance of the antenna unit, according to the invention. The first distance D is reduced to 10 mm or less to improve impedance matching of the antenna apparatus. The first distance D can be further reduced to within 2 to 8 mm to improve real part of input impedance of the antenna unit up to 40 to 60 ohms. Generally, the first distance D may be shorter than 2 mm when considering a trade-off between impedance matching and internal arrangement of slim and compact mobile phone.

To further illustrate the characteristics of the antenna of the present invention, one may use the well-known Smith chart. In the drawings of FIG. 8 to FIG. 12, each Smith chart illustrates an impedance characteristic of the antenna of the present invention between the FM frequency of 88 MHz to 108 MHz. Each Smith chart is normalized and the circle in the chart in which the points $\nabla_1$ and $\blacktriangledown_2$ exist is the locus of the characteristic impedance. It should be noted that the frequency range between 88 MHz to 108 MHz is only an example, not a limitation to the present invention.

Figure 8:
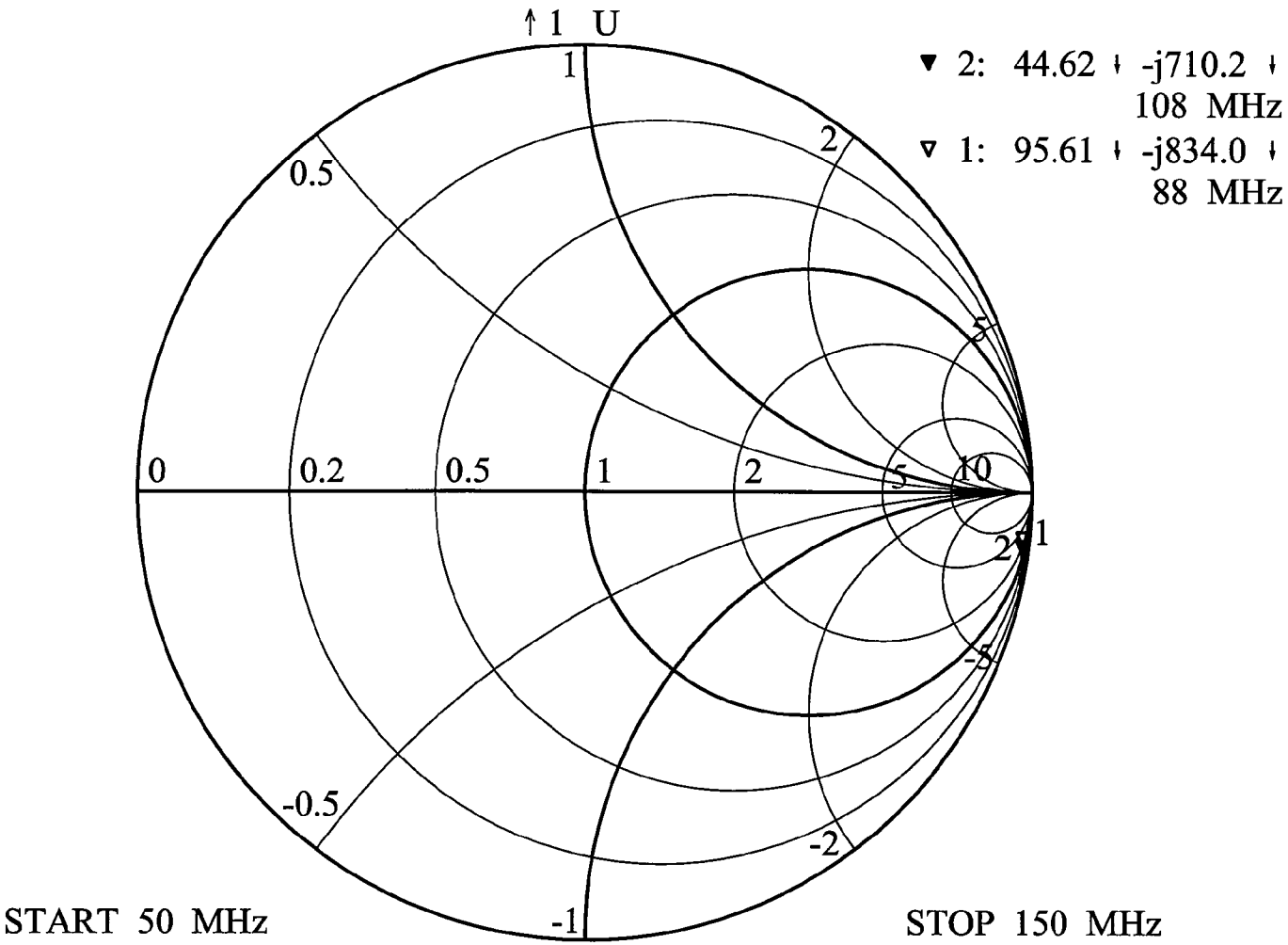
FIG. 8 shows a smith chart of input impedance of antenna unit with length shorter than ¼ operating wavelength.

FIG. 8 shows a smith chart of input impedance of an antenna unit with length shorter than ¼ the operating wavelength. The antenna unit, with one end opened, operates within the range of 88 to 108 MHz and has negative input reactance. In FIG. 8, the input impedances of the antenna unit indicated by $\nabla_1$ and $\blacktriangledown_2$ are about 95.61-j834 and 44.62-j710.2 respectively. As shown in FIG. 8, the points $\nabla_1$ and $\blacktriangledown_2$ are too far away from the center of the smith chart which is the perfect matching point, meaning that the impedances at the points $\nabla_1$ and $\blacktriangledown_2$ are not perfectly matched and most signal power are of a great loss.

Figure 9:
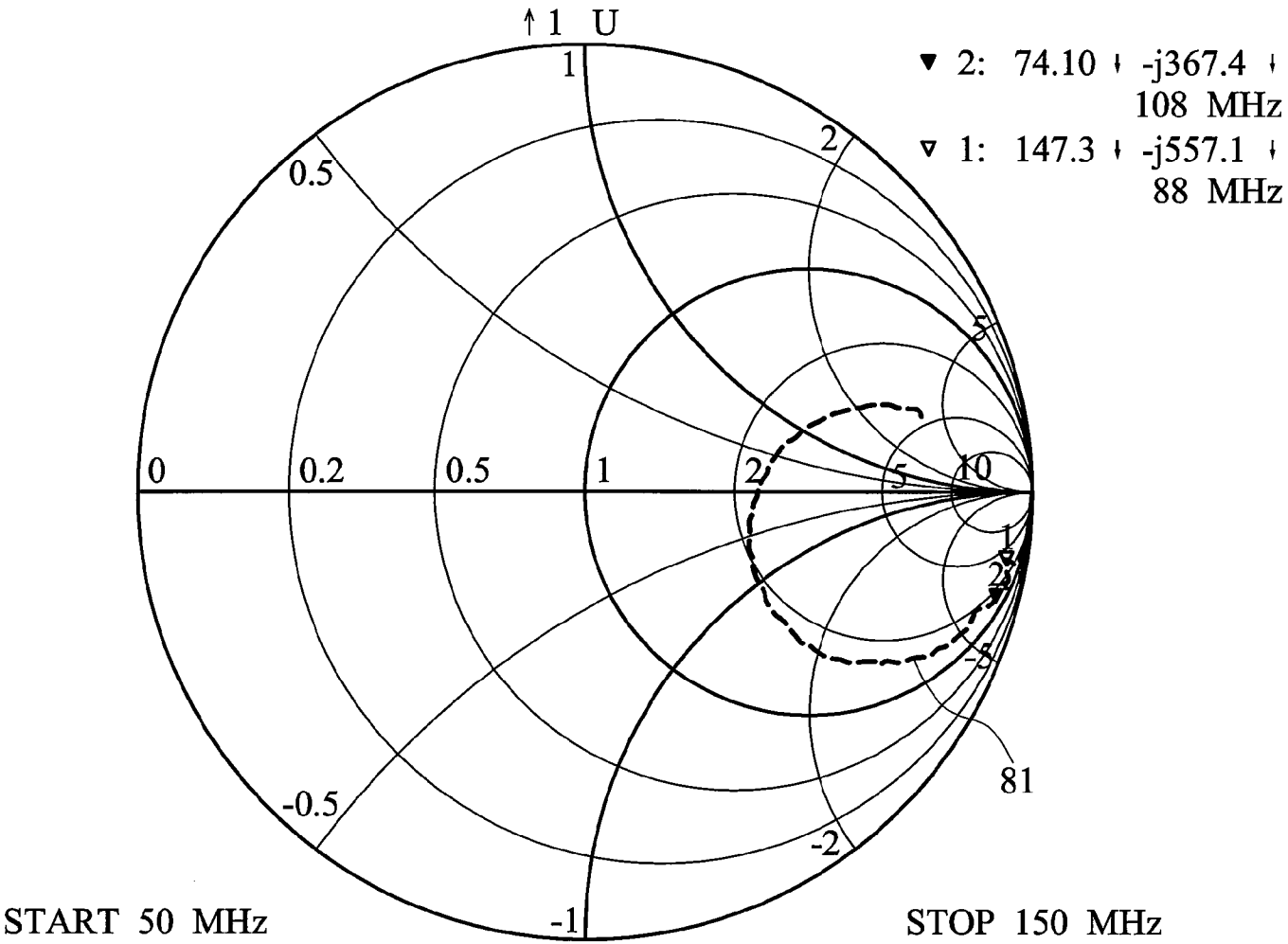
FIG. 9 shows a smith chart of input impedance of an antenna unit with length of 400 mm (shorter than ¼ operating wavelength) according to one embodiment of the invention.

FIG. 9 on the other hand shows a smith chart of input impedance of an antenna unit with length of 400 mm (shorter than ¼ operating wavelength) according to the invention. Here, the antenna unit, with one end open, operates within the range of 88 to 108 MHz, and an inductive reactance device with inductance of 390 nH is used for impedance matching. The first distance D and first angle θ are set to 2 mm and 70 degrees. In FIG. 9, the input impedances (respectively measured at 88 and 108 MHz) of the antenna unit indicated by $\nabla_1$ and $\blacktriangledown_2$ are about 147.3-j557.1 and 74.1-j367.4 respectively.

Figure 10:
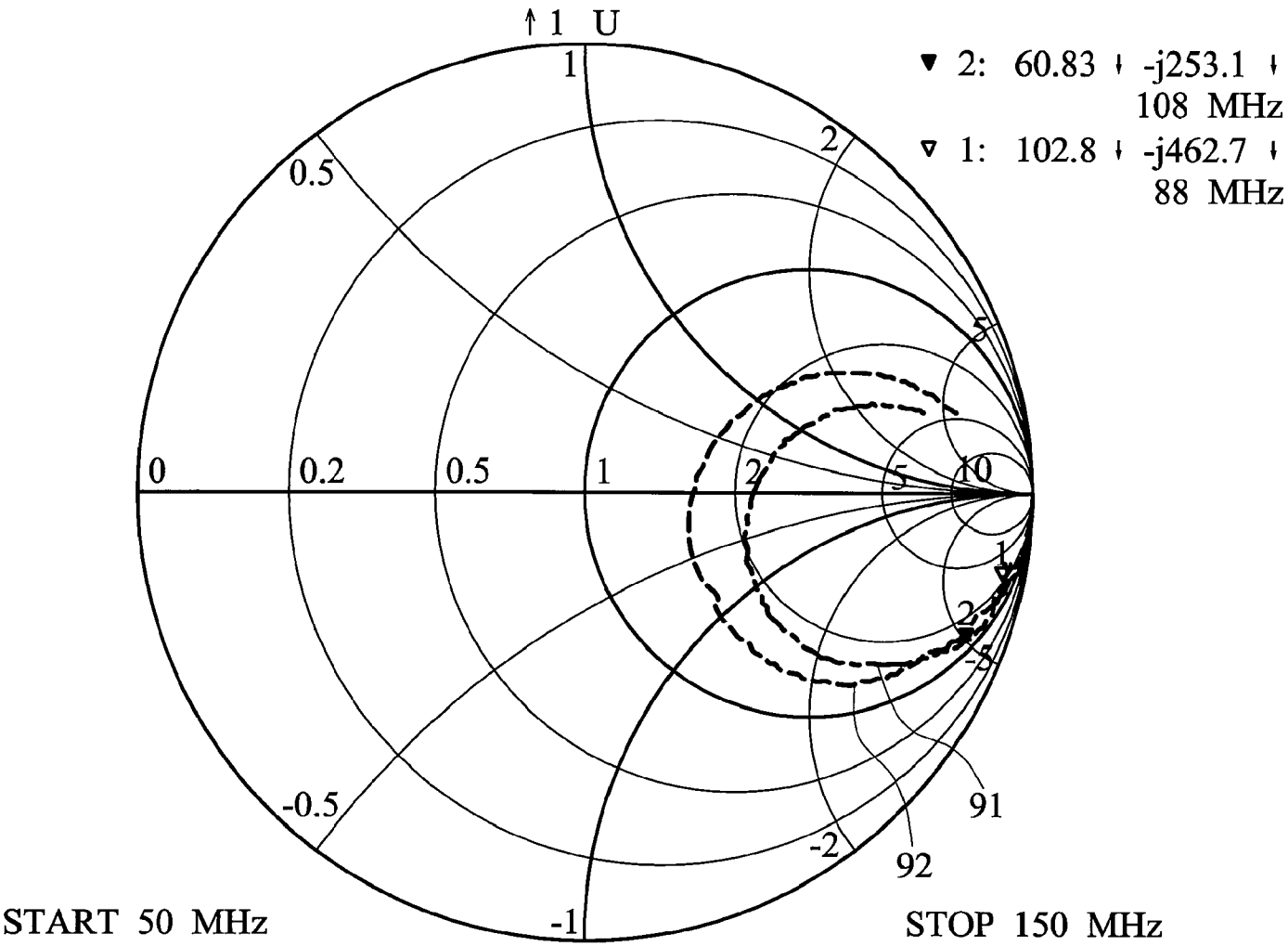
FIG. 10 shows a smith chart of input impedance of an antenna unit with length of 400 mm (shorter than ¼ operating wavelength) according to another embodiment of the invention.

FIG. 10 shows a smith chart of input impedance of another antenna unit with length of 400 mm (shorter than ¼ operating wavelength) according to the invention. The only different test condition is that the first distance D in this is set to 0.5 mm. Other test conditions are the same as described in FIG. 9. In FIG. 10, the input impedances (respectively measured at 88 and 108 MHz) of the antenna unit indicated by $\nabla_1$ and $\blacktriangledown_2$ are about 102.8-j462.7 and 60.83-j253.1 respectively.

Figure 11:
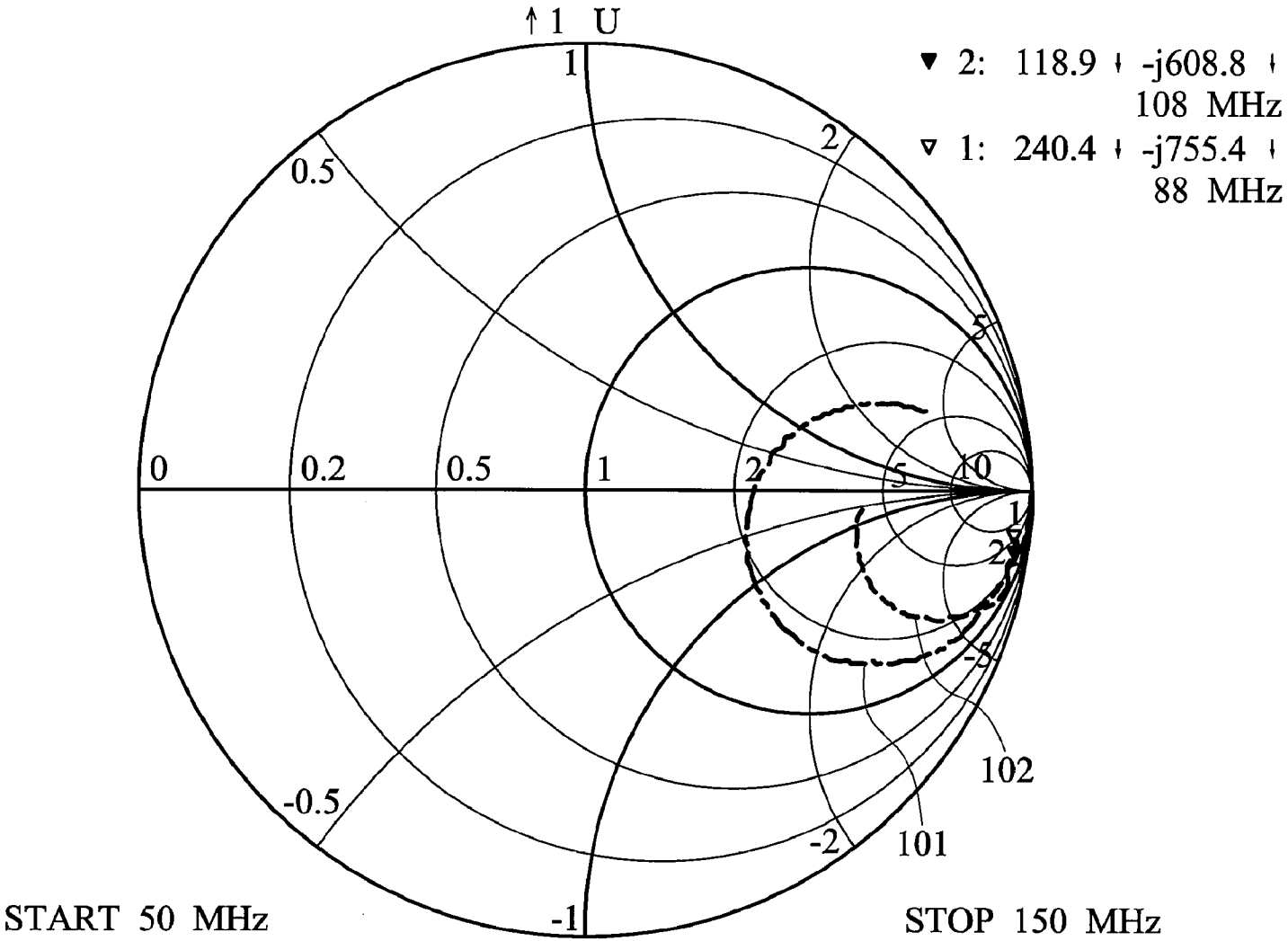
FIG. 11 shows a smith chart of input impedance of an antenna unit with length of 400 mm (shorter than ¼ operating wavelength) according to yet another embodiment the invention.

FIG. 11 shows a smith chart of input impedance of another antenna unit with length of 400 mm (shorter than ¼ operating wavelength) according to the invention. The only different test condition is that the first distance D in this is set to 5 mm. Other test conditions are the same as described in FIG. 9. In FIG. 11, the input impedances (respectively measured at 88 and 108 MHz) of the antenna unit indicated by $\nabla_1$ and $\blacktriangledown_2$ are about 240.4-j755.4 and 118.9-j608.8 respectively.

From results of FIGS. 9 to 11, it is clear that the shorter the first distance D, the less the real part of input impedance of the antenna unit. Thus, designer can appropriately reduce the first distance D to make the real part of the input impedance of the antenna unit closer to the desired resistance 50 ohms. On the contrary, the longer the first distance D, the more the real part of input impedance of the antenna unit.

Figure 12:
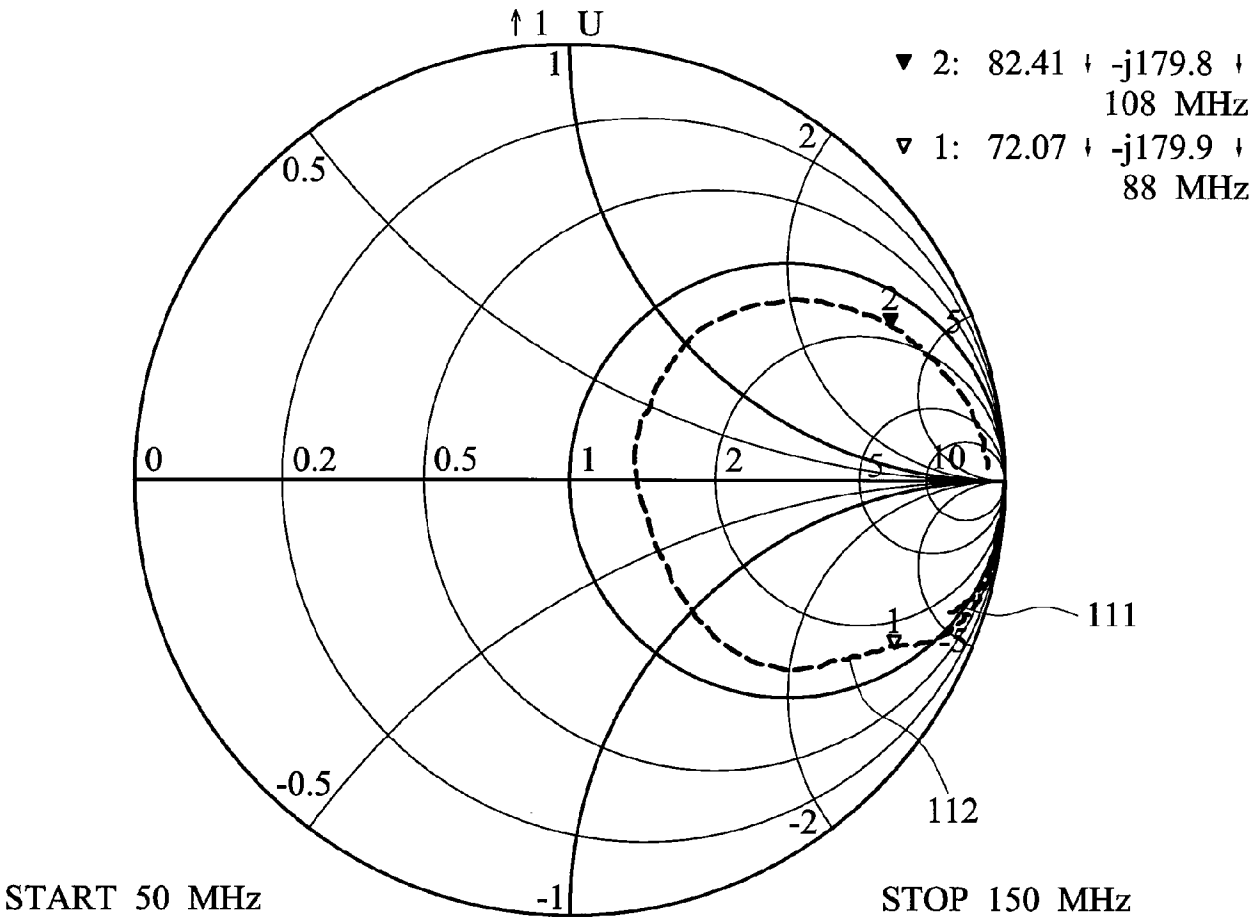
FIG. 12 shows a smith chart of input impedance of an antenna unit with length of 450 mm (shorter than ¼ operating wavelength) according to a preferred embodiment of the invention.

FIG. 12 shows a smith chart of input impedance of a preferred antenna unit with length of 450 mm (shorter than ¼ operating wavelength) according to the invention. Here, the antenna unit, with one end open, operates within the range of 88 to 108 MHz. And an inductive reactance device with inductance of 680 nH is used for impedance matching. The first distance D and first angle θ are set to 1.5 mm and 90 degrees. In FIG. 12, the input impedances (respectively measured at 88 and 108 MHz) of the antenna unit indicated by $\nabla_1$ and $\blacktriangledown_2$ are about 72.07-j179.9 and 82.41-j179.8 respectively. The real part of input impedance of the antenna unit is closer to the desired resistance 50 ohms (i.e., it is closer to the center of the Smith chart or the normalized impedance of 1).

Figure 13:
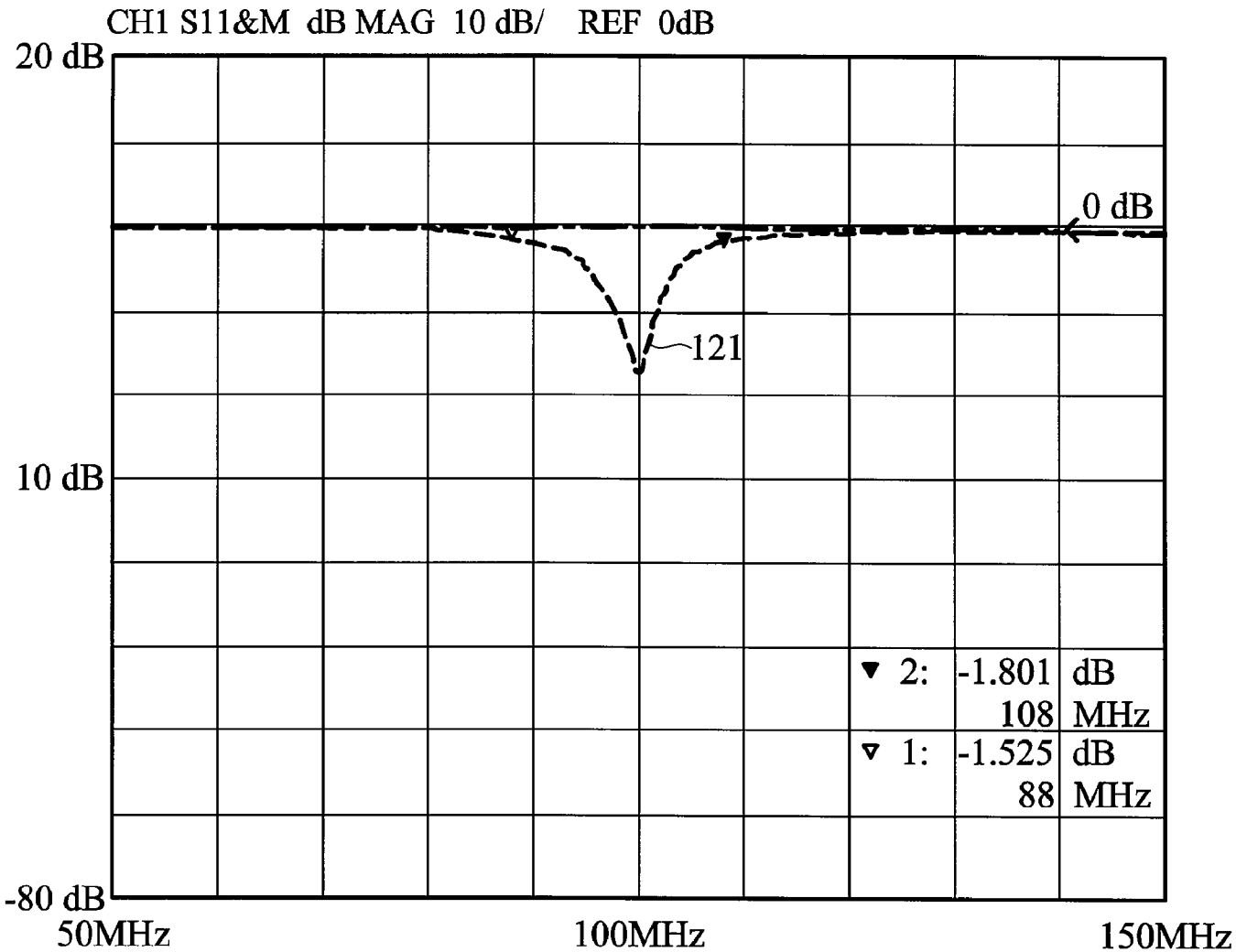
FIG. 13 shows a chart of return loss (S11) of the antenna unit corresponding to FIG. 11.

FIG. 13 shows a chart of return loss (S11) of the antenna unit corresponding to FIG. 12. As shown in FIG. 13, very good impedance matching is achieved in an FM frequency band of 88 to 108 MHz, because the antenna unit suffers the least return loss at the central frequency (about 100 MHz) of the FM frequency band.

Figure 14:
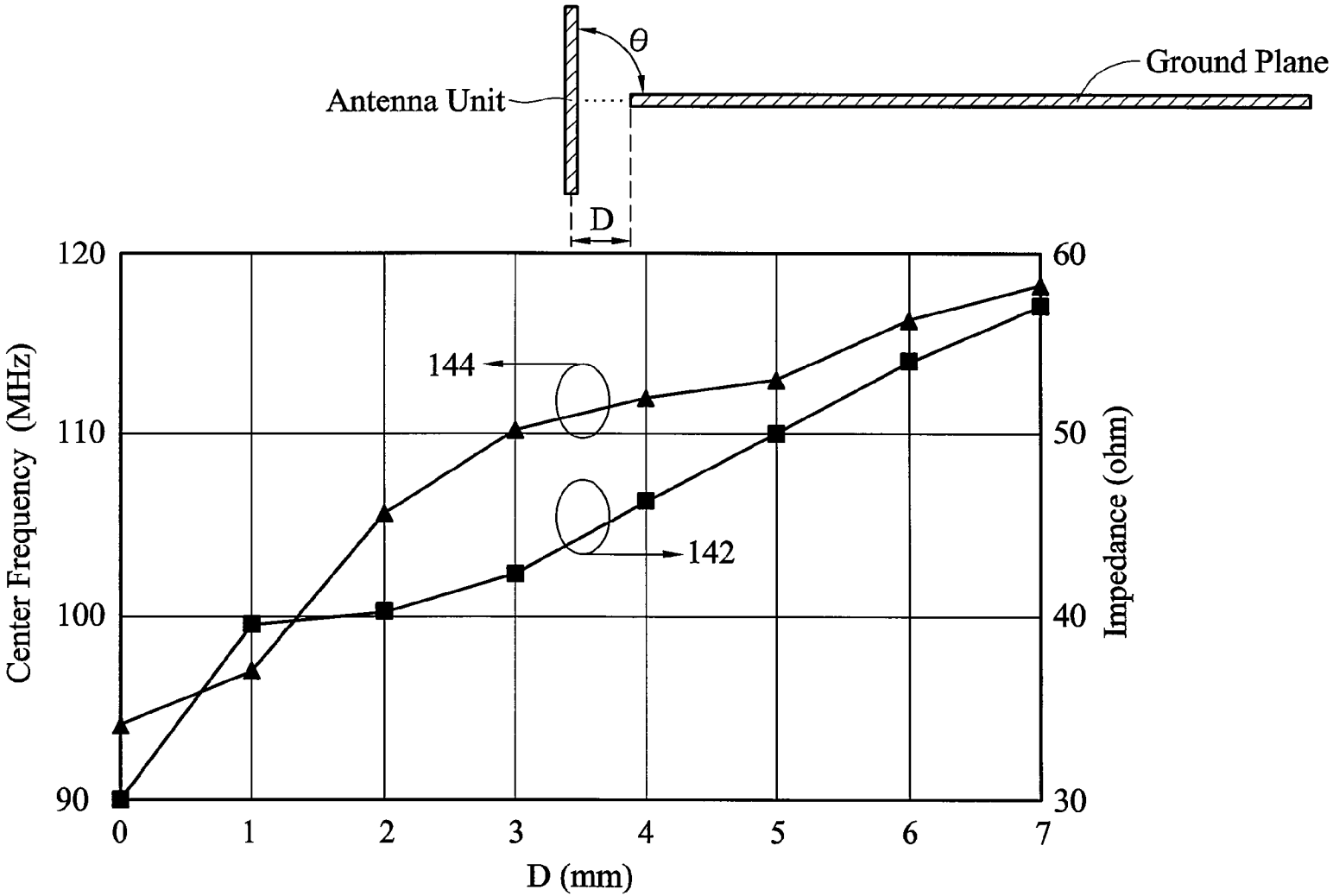
FIG. 14 shows the relationship between the first distance D and some characteristics of an antenna apparatus according to the invention.

FIG. 14 shows the relationship between the first distance D and characteristics of an antenna apparatus according to the invention. Assume that the antenna unit of the antenna apparatus is arranged with a first angle θ of 90 degrees and a first distance D with respect to a ground plane of the antenna apparatus, and the central frequency of the antenna apparatus changes in the frequency range of 90 to 120 MHz. Curve 142 of FIG. 14 shows that the shorter the first distance D, the less the impedance of the antenna unit. Curve 144 of FIG. 14 shows that the shorter the first distance D, the lower the central frequency (with the least return loss). Therefore, not only the impedance but also the central frequency can be tuned by setting the first distance D and the first angle θ.

Operating wavelengths of HF, VHF and UHF applications are longer than 30 cm. Therefore, it is quite difficult to configure a conventional ¼ wavelength antenna inside a mobile communication system. The antenna apparatus of the invention can be easily designed to have length shorter than ¼ operating wavelength by setting a specific distance and angle between an antenna unit and a ground plane thereof, appropriate for applications of HF, VHF and UHF systems with operating frequency lower than 1 GHz.

Figure 15:
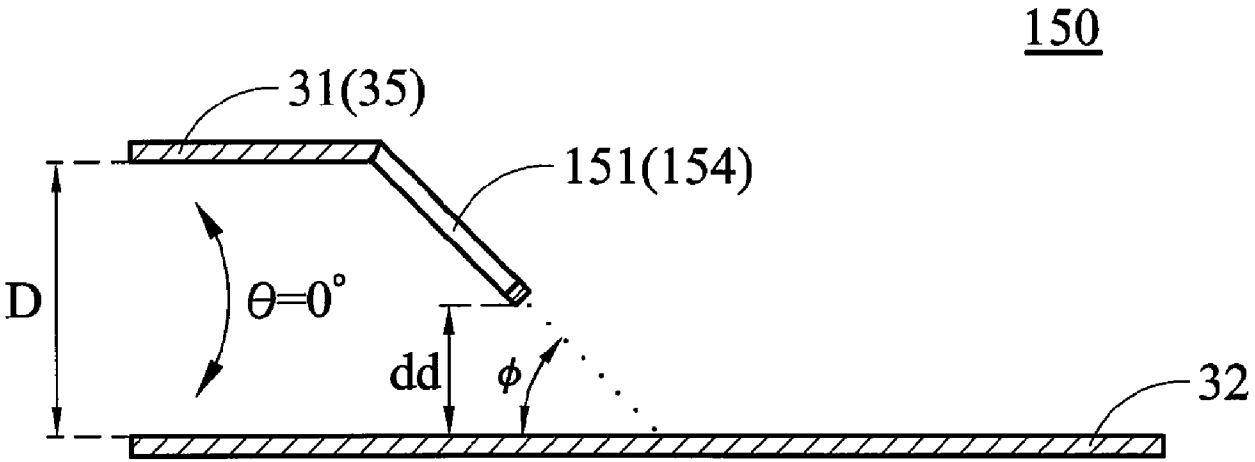
FIG. 15 shows the second distance dd and the second angle ϕ between the second plane 154 and the ground plane 32.

Referring to FIG. 15, The antenna unit 150 can further comprises a second conductor 151 extending from the second end on a second plane 154 different from the first plane 35, for tuning real part of input impedance of the antenna unit 31 by adjusting a second distance dd and a second angle ϕ between the second plane 154 and the ground plane 32. In FIG. 15, the first θ is 0 degree, and advanced tuning can be accomplished by setting the second distance dd and second angle ϕ. It is noted that the second conductor has the same characteristics as described in FIGS. 6A to 6C.

The foregoing descriptions of several exemplary embodiments have been presented for the purpose of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. An antenna apparatus applicable for a wireless device operated in a frequency band, comprising:

an antenna unit comprising a first conductor having a first end for feeding signals and a second end; and a ground plane providing a ground reference to the signals;

wherein there is a first distance between the first conductor and the ground plane, and the first distance is adjustable to improve the impedance matching of the antenna apparatus;

wherein the area of the first conductor is less than 1/64 square of operating wavelength of the antenna unit;

wherein there is an angle between the first conductor and the ground plane, and the angle is adjustable to improve impedance matching of the antenna apparatus; and wherein the antenna unit has an input impedance having a real part and an imaginary part, the real part of the input impedance is adjustable by tuning the angle.

2. The antenna apparatus as claimed in claim 1, wherein the length of the first conductor is shorter than ¼ the operating wavelength of the antenna unit.

3. The antenna apparatus as claimed in claim 1, wherein the frequency bands is between 88~108 MHz.

4. The antenna apparatus as claimed in claim 1, wherein the first distance is shorter than or equal to 15 mm.

5. The antenna apparatus as claimed in claim 1, wherein the first distance is shorter than or equal to 10 mm.

6. The antenna apparatus as claimed in claim 1, wherein the antenna unit has an input impedance having a real part and an imaginary part, the real part of the input impedance is adjustable by changing the first distance.

7. The antenna apparatus as claimed in claim 6, wherein the real part of the input impedance of the antenna unit decreases as the first distance decreases.

8. The antenna apparatus as claimed in claim 1, wherein the antenna unit has an input impedance having a real part and an imaginary part, the antenna unit further comprises a second conductor extending from the second end of the first conductor, wherein the first conductor and the second conductor are on different planes, the second conductor and the ground plane are of a second distance, wherein the real part of the input impedance of the antenna unit is adjustable by changing the second distance.

9. The antenna apparatus as claimed in claim 8, wherein the real part of the impedance of the antenna unit decreases as the second distance decreases.

10. The antenna apparatus as claimed in claim 1, further comprising:

a reactive device coupled to the first end of the antenna unit, wherein the reactive device has inductive components or capacitive components to improve impedance matching of the antenna apparatus.

11. The antenna apparatus as claimed in claim 10, wherein the antenna unit has an input impedance having a real part and an imaginary part, the imaginary part of the input impedance is adjustable by tuning the reactive device.

12. The antenna apparatus as claimed in claim 10, wherein the reactive device further has resistance components.

13. The antenna apparatus as claimed in claim 1, wherein the antenna unit is a monopole antenna with the second end open.

14. The antenna apparatus as claimed in claim 1, wherein the first conductor of the antenna unit has a spiral pattern or meander line pattern. ,

15. The antenna apparatus as claimed in claim 1, wherein the first conductor of the antenna unit is made of a metal trace printed on a supporting member, a metal line or metal sheet.

16. The antenna apparatus as claimed in claim 15, wherein the supporting member comprises a multilayer structure and the metal trace is provided on at least one layer of the layer structure.

17. The antenna apparatus as claimed in claim 1, wherein the second end of the antenna unit serves as a ground end electrically coupled to the ground plane.

18. The antenna apparatus as claimed in claim 1, wherein the real part of the input impedance of the of the antenna unit decreases as the angle decreases.

19. The antenna apparatus as claimed in claim 1, wherein the wireless device is a mobile phone.

20. An antenna unit applicable for a wireless device operated in a frequency band, wherein the wireless device has a circuit module and a ground plane, comprising:

a first conductor having a first end and a second end; and a reactive device, coupled to the first end and the circuit module, for feeding signals from the circuit module to the first end of the first conductor, wherein the reactive device having inductive components or capacitive components;

wherein there is a first distance between the first conductor and the ground plane, the antenna unit has an input impedance having a real part and an imaginary part, the real part of the input impedance is adjustable by changing the first distance and the imaginary part of the input impedance is adjustable by tuning the reactive device;

wherein the length of the first conductor is shorter than ¼ the operating wavelength of the antenna unit;

wherein there is an angle between the first conductor and the ground plane; and wherein the real part of the input impedance of the antenna unit is adjustable by changing the angle.

21. The antenna unit as claimed in claim 20, wherein the frequency band is between 88~108 MHz.

22. The antenna unit as claimed in claim 20, wherein the first distance is shorter than or equal to 15 mm.

23. The antenna unit as claimed in claim 20, further comprising:

a second conductor extending from the second end of the first conductor, wherein the first conductor and the second conductor are on different planes, the second conductor and the ground plane are of a second distance, wherein the real part of the input impedance of the antenna unit is adjustable by changing the second distance.

24. The antenna unit as claimed in claim 20, wherein the reactive device further has the resistance components.

25. The antenna unit as claimed in claim 20, wherein the antenna unit is a monopole antenna with the second end open.

26. The antenna unit as claimed in claim 20, wherein the first conductor of the antenna unit has a spiral pattern or meander line pattern.

27. The antenna unit as claimed in claim 20, wherein the second end of the antenna unit serves as a ground end electrically coupled to the ground plane.

28. The antenna unit as claimed in claim 20, wherein the wireless device is a mobile phone.

* * * * *

UNITED STATES PATENT AND TRADEMARK OFFICE

CERTIFICATE OF CORRECTION

PATENT NO. : 7,633,446 B2
APPLICATION NO. : 11/424041
DATED : December 15, 2009
INVENTOR(S) : Fang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 709 days.

Signed and Sealed this

Ninth Day of November, 2010

David J. Kappos

David J. Kappos
*Director of the United States Patent and Trademark Office*